US007685921B2

(12) United States Patent
Dagher et al.

(10) Patent No.: US 7,685,921 B2
(45) Date of Patent: Mar. 30, 2010

(54) COMPOSITE PANELS FOR BLAST AND BALLISTIC PROTECTION

(75) Inventors: Habib J. Dagher, Veazie, ME (US); Keenan M. Goslin, Old Town, ME (US); Eric D. Cassidy, Hampden, ME (US); Laurent R. Parent, Veazie, ME (US); Edwin N. Nagy, Orono, ME (US)

(73) Assignee: University of Maine System Board of Trustees, Bangor, ME (US)

( * ) Notice: Subject to any disclaimer, the term of this patent is extended or adjusted under 35 U.S.C. 154(b) by 154 days.

(21) Appl. No.: 11/699,872

(22) Filed: Jan. 30, 2007

(65) Prior Publication Data

US 2007/0180982 A1 Aug. 9, 2007

Related U.S. Application Data

(60) Provisional application No. 60/765,109, filed on Feb. 3, 2006, provisional application No. 60/765,546, filed on Feb. 6, 2006.

(51) Int. Cl.
*F41H 5/02* (2006.01)

(52) U.S. Cl. ..... 89/36.02; 89/36.01; 89/914; 89/918; 89/920; 109/80; 109/81; 109/82; 109/83; 109/84

(58) Field of Classification Search ..... 89/36.02
See application file for complete search history.

(56) References Cited

U.S. PATENT DOCUMENTS

| | | | | |
|---|---|---|---|---|
| 4,079,161 | A | 3/1978 | Kile | |
| 4,683,800 | A * | 8/1987 | Snedeker | 89/36.02 |
| 4,842,923 | A * | 6/1989 | Hartman | 428/219 |
| 5,306,557 | A * | 4/1994 | Madison | 428/304.4 |
| 5,536,553 | A * | 7/1996 | Coppage et al. | 428/102 |
| 6,253,655 | B1 * | 7/2001 | Lyons et al. | 89/36.02 |
| 6,532,857 | B1 * | 3/2003 | Shih et al. | 89/36.02 |
| 6,568,310 | B2 * | 5/2003 | Morgan | 89/36.02 |
| 6,581,505 | B1 | 6/2003 | Levell | |
| 6,807,891 | B2 * | 10/2004 | Fisher | 89/36.02 |
| 6,949,280 | B2 * | 9/2005 | Brillhart et al. | 428/105 |
| 2004/0144244 | A1 * | 7/2004 | Sargent | 89/36.02 |
| 2005/0144900 | A1 * | 7/2005 | Hallissy et al. | 52/782.1 |
| 2006/0027089 | A1 * | 2/2006 | Cordova et al. | 89/36.02 |
| 2007/0293107 | A1 * | 12/2007 | Follo et al. | 442/134 |

* cited by examiner

*Primary Examiner*—Troy Chambers
*Assistant Examiner*—Samir Abdosh
(74) *Attorney, Agent, or Firm*—MacMillan, Sobanski & Todd, LLC

(57) ABSTRACT

A ballistic and blast protective composite panel includes a first composite layer and a second composite layer.

20 Claims, 6 Drawing Sheets

COMPOSITE PANELS FOR BLAST AND BALLISTIC PROTECTION

CROSS REFERENCE TO RELATED APPLICATIONS

This application claims the benefit of U.S. Provisional Application No. 60/765,109 filed Feb. 3, 2006 and U.S. Provisional Application No. 60/765,546 filed Feb. 6, 2006.

BACKGROUND

Various embodiments of a protective armor panel are described herein. In particular, the embodiments described herein relate to an improved multifunctional composite panel for blast and ballistic protection.

Protective armor typically is designed for several applications types: personal protection such as helmets and vests, vehicle protection such as for high mobility multi-wheeled vehicles (HMMWVs), and rigid structures such as buildings. Important design objectives for personal protection include, for example, protection against ballistic projectiles, low weight, and good flexure. Vehicles and rigid structures often require superior ballistic and blast protection and low cost per unit area.

Blast protection typically requires the material to have the structural integrity to withstand the high loads of blast pressure. Ballistic protection typically requires the material to stop the progress of bomb fragments ranging in size from less than one millimeter to 10 mm or more and traveling at velocities in excess of 2000 meters per second for smaller fragments.

Accordingly, personal protective armor is often made of low weight, high tech materials having a high cost per unit area. High unit area cost may be acceptable to the user because people present low surface area relative to vehicles and buildings. The materials used in personal protective armor products do not need high load bearing capabilities because either the body supports the material, such as in a vest, or the unsupported area is very small, such as in a helmet.

As a result of the blast, ballistic, and low unit area cost requirements for vehicles and structures, the materials used in blast protection are typically heavier materials, including for example, metals and ceramics. Such materials may not always be low cost. Such materials may further be of usually high weight per unit area.

SUMMARY

The present application describes various embodiments of a ballistic and blast protective composite panel. One embodiment of the ballistic and blast protective composite panel includes a first composite layer and a second composite layer.

The present application additionally describes various embodiments of a ballistic and blast protection system including a plurality of protective composite panels, wherein each panel includes a first composite layer, a second composite layer, a core disposed between the first and second composite layers, a backing layer disposed on an outwardly facing surface of the second composite layer, an encapsulation layer covering all exposed surfaces of the protective composite panel, and a fiber layer between the backing layer and the encapsulation layer. The ballistic and blast protection system further includes an elongated member, and a connection system connecting each composite panel to at least one of the elongated member and an adjacent composite panel.

Another embodiment of the ballistic and blast protective composite panel includes a first composite layer comprising glass fiber and thermoplastic resin and a second composite layer comprising glass fiber and thermoplastic resin. A core is disposed between the first and second composite layers, the core being formed from one of wood and a wood product. A backing layer is disposed on an outwardly facing surface of the second composite layer, the backing layer including aramid material. A polypropylene encapsulation layer covers all exposed surfaces of the protective composite panel. A layer of polyester fiber is between the backing layer and the encapsulation layer, wherein the protective composite panel includes an attachment slot formed therein.

Other advantages of the ballistic and blast protective composite panel will become apparent to those skilled in the art from the following detailed description, when read in light of the accompanying drawings.

DETAILED DESCRIPTION OF THE INVENTION

Members of the military or other persons located in combat or hostile fire areas may work or sleep in temporary or semi-permanent structures that require protection from blast and/or from ballistic projectiles. Examples of such structures include tents, South East Asia huts (SEAHUTS), and containerized housing units (CHU). It will be understood that other types of temporary, semi-permanent, or permanent structures may require protection from blast and/or from ballistic projectiles.

Like personal protective armor, but unlike protective armor provided for vehicles and permanent structures, the weight of such protection is an important consideration for two reasons. First, the material in panel form should be light enough to be moved and installed by persons, such as members of the military, without lifting equipment. Second, the panels should be light enough so as not to overstress the tent frame either statically or dynamically. Desirably, blast and ballistic protection for temporary or semi-permanent structures will have a low unit area cost because the surface area to be covered of such temporary or semi-permanent structures is large. Additionally, the ballistic protection must have sufficient structural integrity to withstand blast forces over a relative long span, because many such temporary or semi-permanent structures have widely spaced support or framing members.

Figure 1:
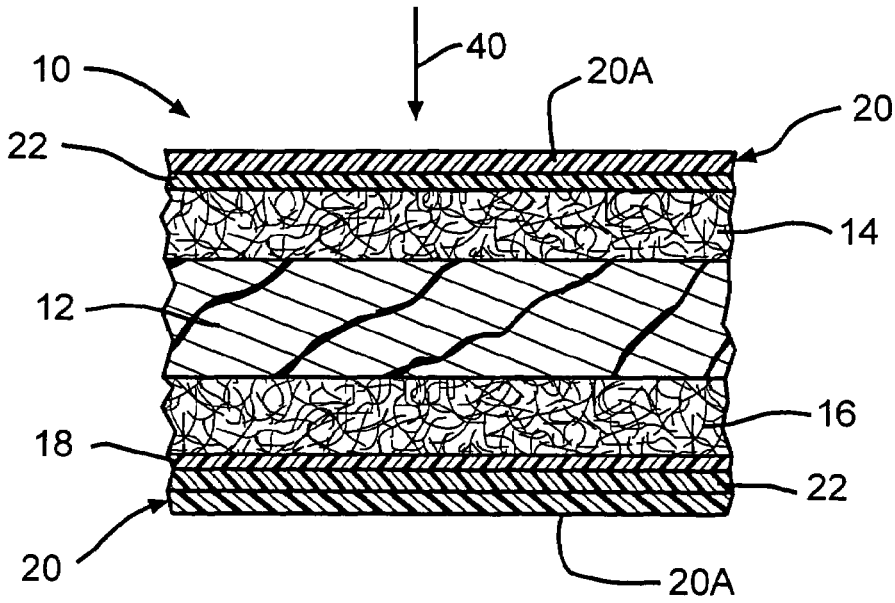
FIG. 1 is a schematic cross-sectional view of a first embodiment of the protective composite panel.

Referring now to FIG. 1, there is illustrated generally at 10 a schematic view of a first embodiment of a protective composite panel. The illustrated composite panel 10 includes a core 12, a first composite layer or strike face 14, a second composite layer or back face 16, a backing layer 18, and an outer layer or encapsulation layer 20, each of which will be described in detail below.

The core 12 may be formed from wood or a wood product, such as for example, oriented strand board (OSB), balsa, plywood, and any other desired wood or wood product. Additionally, the core 12 may be formed from plastic or any other desired non-wood material. For example, the core 12 may be formed as a honeycomb core made of thermoplastic resin, thermosetting resin, or any other desired plastic material. In the illustrated embodiment, the core 12 is within the range of from about ⅛ inch to about ⅜ inch thick. Alternatively, the core 12 may be any other desired thickness.

The strike face 14 may comprise one or more layers of high-performance fibers and thermoplastic resins chosen for durability, level of protection, to reduce manufacturing costs, and to enhance adhesion between the core 12 and the strike face 14. The strike face 14 may include glass fibers, including for example, glass fibers and woven or unwoven glass mats. For example, the strike face 14 may include B-glass fibers, S-glass fibers, woven aramid fiber such as K760 formed from KEVLAR®, or a KEVLAR® fabric such as HEXFORM®, a material manufactured by Hexcel Corporation of Connecticut, non-woven KEVLAR® fabric, such as manufactured by Polystrand Corporation of Colorado, and any other material having desired protection from ballistic projectile fragment penetration. The strike face 14 may also include any combination of B-glass fibers, S-glass fibers, woven KEVLAR® fibers, and non-woven KEVLAR® fibers. It will be understood that any other suitable glass and non-glass fibers may also be used.

The strike face 14 may also include thermoplastic resin, such as for example, polypropylene (PP), polyethylene (PE), and the like. If desired, the strike face 14 may be formed with additives, such as for example ultra-violet inhibitors to increase durability, fire inhibitors, and any other desired performance or durability enhancing additive. Advantageously, use of thermoplastic resin at the interface between the wood-based core 12 and either or both of the strike face 14 and the back face 16 promotes adhesion between the core 12 and the faces 14 and 16.

In a first embodiment of the strike face 14, the strike face 14 may be formed from dry glass fibers disposed on and/or between one or more layers of thermoplastic resin sheet or thermoplastic resin film. In such an embodiment, the fibers and resin may be heated to bond the fiber with the resin.

In a second embodiment of the strike face 14, one or more sheets of glass fiber with thermoplastic resin encapsulated or intermingled therewith, may be provided.

The back face 16 may be substantially identical to the strike face 14, and will not be separately described.

The backing layer 18 may be formed from material which provides additional protection from both blast and ballistic projectile fragment penetration, such as for example, material formed of an aramid fiber. In a first embodiment of the backing layer 18, the layer 18 is formed from a sheet or film of KEVLAR®. In a second embodiment of the backing layer 18, the layer 18 is formed from non-woven KEVLAR® fibers. In a third embodiment of the backing layer 18, the layer 18 may be formed from woven KEVLAR® fibers, such as K760 and HEXFORM®. In a fourth embodiment of the backing layer 18, the layer 18 may be formed from a sheet or film of any other material having desired protection from ballistic projectile fragment penetration.

Figure 2:
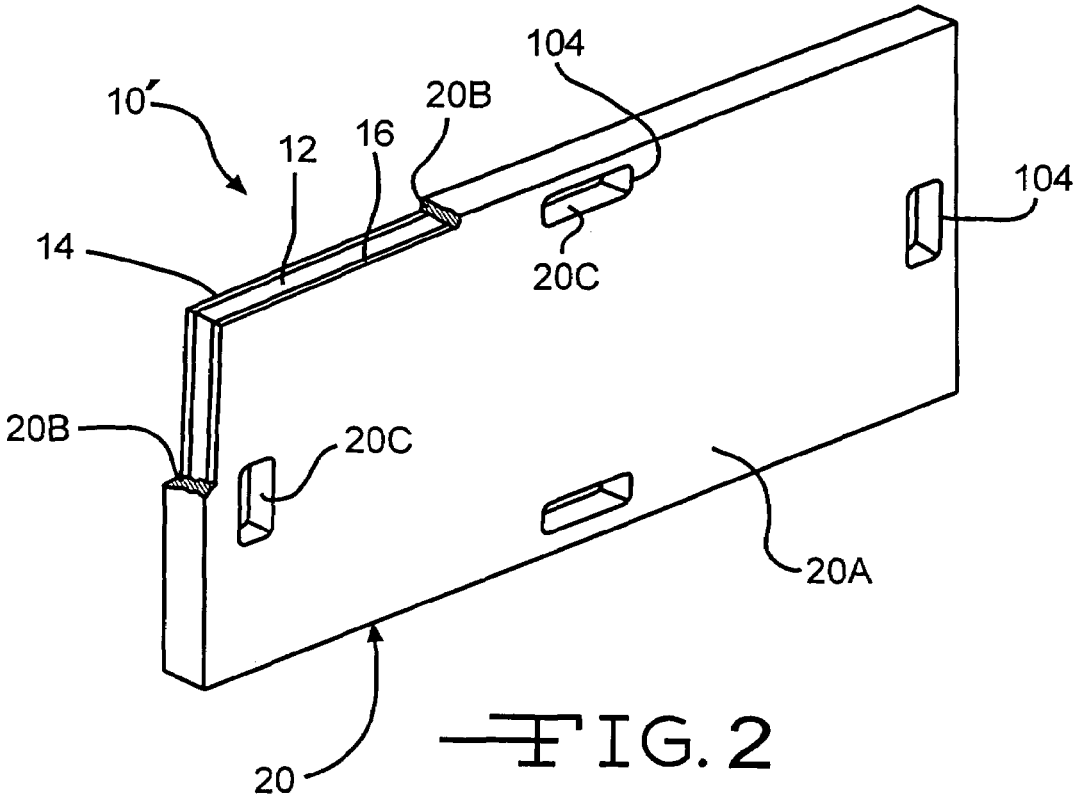
FIG. 2 is a perspective view of a second embodiment of the protective composite panel illustrated in FIG. 1.

Referring now to FIG. 2, there is illustrated generally at 10' a perspective view of a second embodiment of a protective composite panel. The illustrated composite panel 10' includes an outer or encapsulation layer 20 which encapsulates the strike face 14, core 12, back face 16, and backing layer 18. The illustrated encapsulation layer 20 is formed from polypropylene. Alternatively, the encapsulation layer 20 may be formed from any other material, such as for example, any material compatible with the thermoplastic resin of the strike face 14 and back face 16. Such an encapsulation layer 20 protects the strike face 14, core 12, back face 16, and backing layer 18 from the negative effects of the environment, such as excess moisture. The illustrated composite panel 10' includes a plurality of slots or carrying handles 104, which will be described in detail below.

The illustrated encapsulation layer 20 includes a first portion 20A disposed on the broad faces of the composite panel 10'. In the illustrated embodiment, the first portion 20A of the encapsulation layer 20 is within the range of from about 0.002 inch to about 0.010 inch thick. It will be understood that the first portion 20A of the encapsulation layer 20 may have any other desired thickness. The illustrated encapsulation layer 20 includes a second portion 20B disposed about the peripheral edge of the composite panel 10'. In the illustrated embodiment, the second portion 20B of the encapsulation layer 20 is within the range of from about ⅛ inch to about ½ inch thick. It will be understood that the second portion 20B of the encapsulation layer 20 may have any other desired thickness. The encapsulation layer 20 may also include a third portion 20C disposed on the inner surfaces of the slots 104.

If desired, the composite panel 10' may be provided with a fiber layer 22 between the back face 16 and/or backing layer 18 and the encapsulation layer 20, and between the strike face 14 and the encapsulation layer 20. The fiber layer 22 illustrated in FIG. 1 is a layer of non-woven polyester fibers having a weight within the range of from about ¼ once per square yard (oz/yd$^2$) to about 1½ oz/yd$^2$. The fiber layer 22 may be formed from any other materials, such as for example, any fibers having a melting point above the melting point of the polypropylene encapsulation layer 20 or other encapsulation layer material, and may have any other desired weight.

Figures 9, 10:
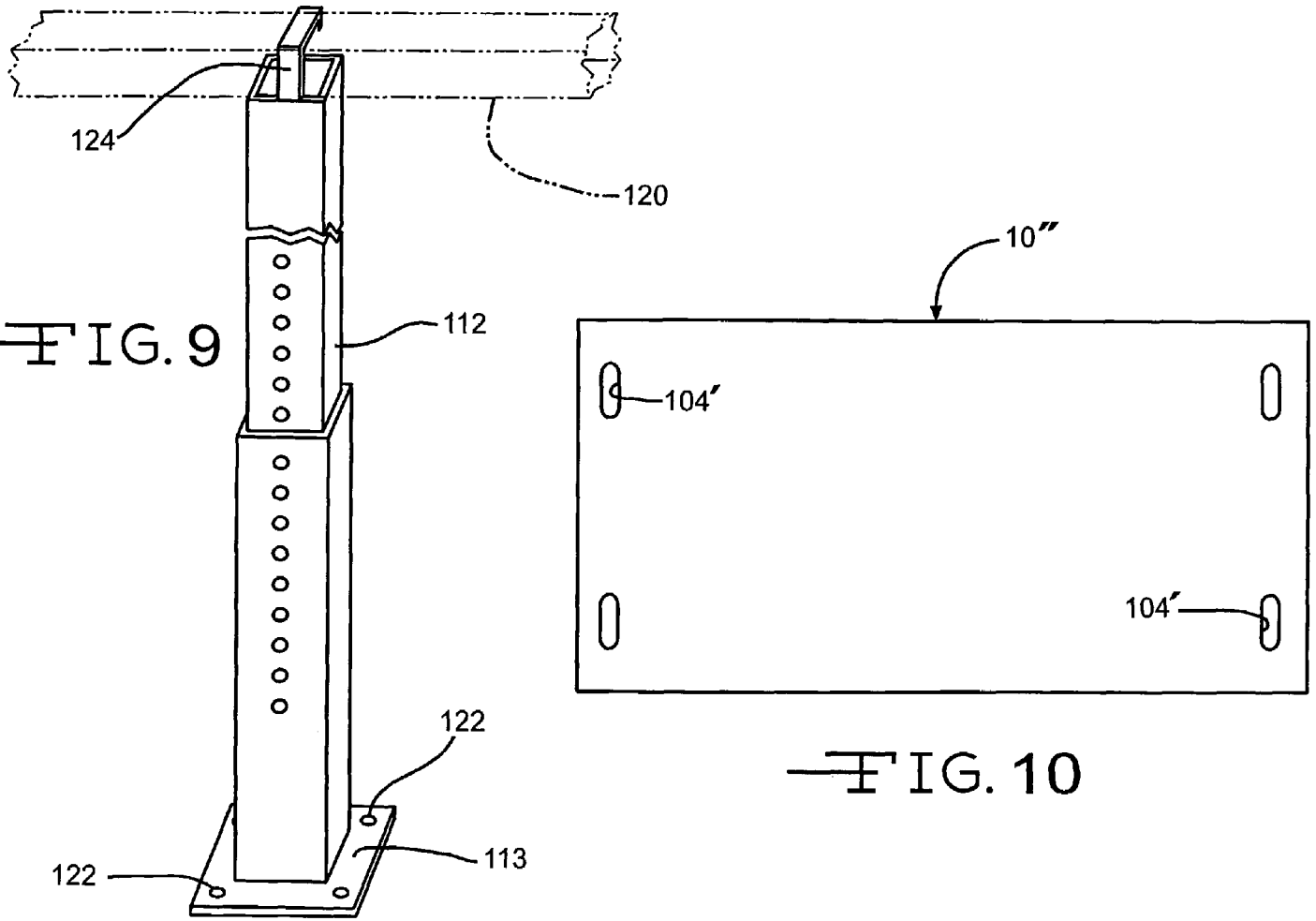
FIG. 9 is a perspective view of a supplementary vertical member for a tent.
FIG. 10 is a schematic front view of a third embodiment of the protective composite panel illustrated in FIGS. 1 and 2.

Referring now to FIG. 10, there is illustrated generally at 10" a schematic front view of a third embodiment of a protective composite panel. The illustrated composite panel 10" is substantially identical to the protective composite panel 10', and includes an alternate arrangement of the carrying handles 104'.

In a first embodiment of the process of manufacturing the protective composite panel 10, the strike face 14, the core 12, the back face 16, and backing layer 18 may be arranged in layers adjacent one another and pressed and heated to melt the thermoplastic resin in the faces 12, 16, the heated resin thereby bonding the faces 12, 16 to the core 12, and bonding the backing layer 18 to the face 16. The press may provide within the range of from about 50 psi to about 150 psi of pressure and within the range of from about 300 degrees F. to about 400 degrees F. of heat to the layers.

If desired, the layers of material (i.e. the layers defining the strike face 14, the core 12, the back face 16, and backing layer 18) may be fed from continuous rolls or the like, and through a continuous press to form a continuous panel. Such a continuous panel may be then be cut to any desired length and/or width.

If desired, the strike face 14, the core 12, the back face 16, and backing layer 18 may be pre-cut to a desired size, such as for example 4 ft×8 ft, and pressed under heat and pressure as described above, to form the composite panel 10. Alternatively, the composite panel 10 may be formed without the backing layer 18, and/or without the core 12.

When forming a relatively thin composite panel 10, such as for example a panel having a thickness less than about ¼ inch, the core 12 and face layers 14 and 16 may be fed into a press, heated and compacted within the press under pressure to form the composite panel 10, and cooled as it is removed from the press.

When forming a relatively thicker composite panel 10, such as for example a panel having a thickness greater than about ⅝ inch, the face layers 14 and 16 may be first preheated. The core 12 and face layers 14 and 16 may then be fed into a press, further heated and compacted within the press under pressure to form the composite panel 10, and cooled as it is removed from the press. Composite panels 10 having a thickness within the range of from about ¼ inch to about ⅝ inch may be treated as either relatively thin or relatively thicker composite panels 10, depending on the specific heat transfer properties of the panel. It will be understood that one skilled in the art will be able to determine the desired forming method for composite panels 10 having a thickness within the range of from about ¼ inch to about ⅝ inch through routine experimentation.

When forming the encapsulated composite panel 10', the pressed panel 10' may be placed into a press with the first portion 20A and the second portion 20B of the encapsulation layer 20, and heated and compacted within the press under pressure to form the encapsulated composite panel 10', and cooled as it is removed from the press.

Table 1 lists 24 alternate embodiments of strike face 14, core 12, back face 16, and backing layer material combinations, each of which define a distinct embodiment of the composite panel 10. The composite panel 10 may be formed with any desired combination of layers. Composite panels 10, such as the exemplary panels listed in table 1, combine the unique properties of each component layer to meet both ballistic and structural blast performance requirements, as may be desired by a user of the panel. It will be understood that any other desired combination of strike face 14, core 12, back face 16, and backing layer materials may also be used. Table 1 further lists the areal density (in pounds/foot$^2$) for each embodiment of the composite panel 10. As used herein, areal density is defined as the mass of the composite panel 10 per unit area.

For example, one embodiment of the panel 10 may be formed from one or more layers of S-glass (with thermoplastic resin), a layer of balsa, one or more layers of S-Glass (with thermoplastic resin), and a layer of aramid, such as KEVLAR®.

Another embodiment of the panel 10 may be formed, in order, from one or more layers of E-glass (with thermoplastic resin), a layer of OSB, and one or more layers of E-Glass (with thermoplastic resin).

Another embodiment of the panel 10 may be formed, in order, from a layer of E-glass and a layer of S-glass (with thermoplastic resin), a layer of either OSB, balsa, or plywood, and a layer of E-glass and a layer of S-glass (with thermoplastic resin).

Another embodiment of the panel 10 may be formed, in order, from a layer of E-glass and a layer of S-glass (with thermoplastic resin), a layer of either OSB, balsa, or plywood, a layer of E-glass and a layer of S-glass (with thermoplastic resin), and a layer of aramid, such as Kevlar®.

Another embodiment of the panel 10 may be formed, in order, from one or more layers of S-glass (with thermoplastic resin), a layer of balsa, and one or more layers of S-Glass (with thermoplastic resin).

It will be understood that protective panels having an aramid backing layer, such as KEVLAR®, may be formed having a lower optimal weight relative to similarly performing panels formed without an aramid backing layer. It will be further understood that protective panels without an aramid backing layer may be formed having a lower cost relative to the cost of similarly performing panels having an aramid layer.

It will be understood that protective panels 10 may be formed having material layer compositions different from the exemplary panels described in table 1, or described herein above.

One advantage of the embodiments of each composite panel 10 listed in table 1 meet the level of ballistic performance defined in National Institute of Justice (NIJ) Standard 0101.04. Another advantage of the embodiments of each composite panel 10 listed in table 1 is that each panel can withstand and provide protection from close proximity blast forces, such as blast forces equivalent to the blast (as indicated by the arrow 40) from a mortar within close proximity to the panel 10.

Another advantage is that the thermoplastic resins, such as PP and PE, used to form the strike face 14 and the back face 16 have been shown to reduce manufacturing costs relative to panels formed using thermosetting-based composites in the faces 14 and 16.

Another advantage is that the use of higher thermoplastic resin content at the interface between the faces 14 and 16 and the core 12 has been shown to promote enhanced adhesion of the faces 14 and 16 to the core 12.

Another advantage is that the use of UV inhibitors in the resin has been shown to increase durability of the panel 10.

Another advantage of the panels 10 listed in table 1 is that most of the 24 embodiments listed have an areal density of within the range of about 2.0 psf to about 4.25 psf, and the cost to manufacture the panels 10 is lower relative to the manufacturing costs typically associated with manufacturing known composite panels.

Another advantage of the panels 10 listed in table 1 is that they meet the flammability standards described in the American Society for Testing and Materials (ASTM) standard ASTM E 1925.

TABLE 1

| Embodiment No. | Composite Panel Composition (Alternate Embodiments) | Areal Density (psf) |
|---|---|---|
| 1. | $E_{11}/O/E_{11}$ | 4.22 |
| 2. | $E_{11}/B/E_{11}$ | 3.54 |
| 3. | $E_{10}/O/E_{10}$ | 3.92 |
| 4. | $E_{10}/B/E_{10}$ | 3.24 |
| 5. | $S_9/B/S_9$ | 2.51 |
| 6. | $S_9/B/S_6/H_2$ | 2.34 |
| 7. | $E_{20}$ | 2.96 |
| 8. | $S_8/B/S_8$ | 2.37 |
| 9. | $E_5/S_5/B/E_5/S_5$ | 3.00 |
| 10. | $E_5/S_5/B/E_4/S_2/H_2$ | 2.72 |
| 11. | $E_1/S_1/E_1/S_1/E_1/H_1/E_1/H_1$ | 2.72 |
| 12. | $E_{11}/B/E_{10}/H_1$ | 3.54 |
| 13. | $E_{11}/O/E_{10}$ | 4.05 |
| 14. | $S_9/B/S_6/K760_2$ | 2.48 |
| 15. | $K760_1/S_9/B/S_6/K760_2$ | 2.58 |
| 16. | $E_6/B/E_1/H_{10}$ | 2.37 |
| 17. | $E_6/B/E_1/K760_{10}$ | 2.32 |
| 18. | $K760_5/E_6/B/E_1/K760_{10}$ | 2.32 |

TABLE 1-continued

| Embodiment No. | Composite Panel Composition (Alternate Embodiments) | Areal Density (psf) |
|---|---|---|
| 19. | $E_6/B/E_1/KP_{10}$ | 2.20 |
| 20. | $E_6/B/E_1/K760_{13}$ | 2.61 |
| 21. | $E_9/B/E_1/KP_{11}$ | 2.65 |
| 22. | $E_7/B/E_1/KP_5/E_1/B/E_1/KP_6$ | 3.18 |
| 23. | $E_{10}/B/E_1/KP_5/E_1/B/E_1/KP_{10}$ | 4.02 |
| 24. | $E_5/B/S_5/B/S_5$ | 3.96 |

key:
subscript denotes the number of layers of material.
B ¼ in balsa wood
E E glass
H HEXFORM ®
K K760
KP KEVLAR ®Poly
O ¼ in OSB
S S glass The various embodiments of the panel 10 as described herein my be used in any desired application, such as for example in tents, SEAHUTS, residential and commercial construction, other military and law enforcement applications, and recreational applications. For example, the panels 10 may be used in lieu of plywood or OSB when constructing SEAHUTS or other residential and commercial buildings requiring enhanced protection from blasts and ballistic projectiles.

Figures 3, 3A:
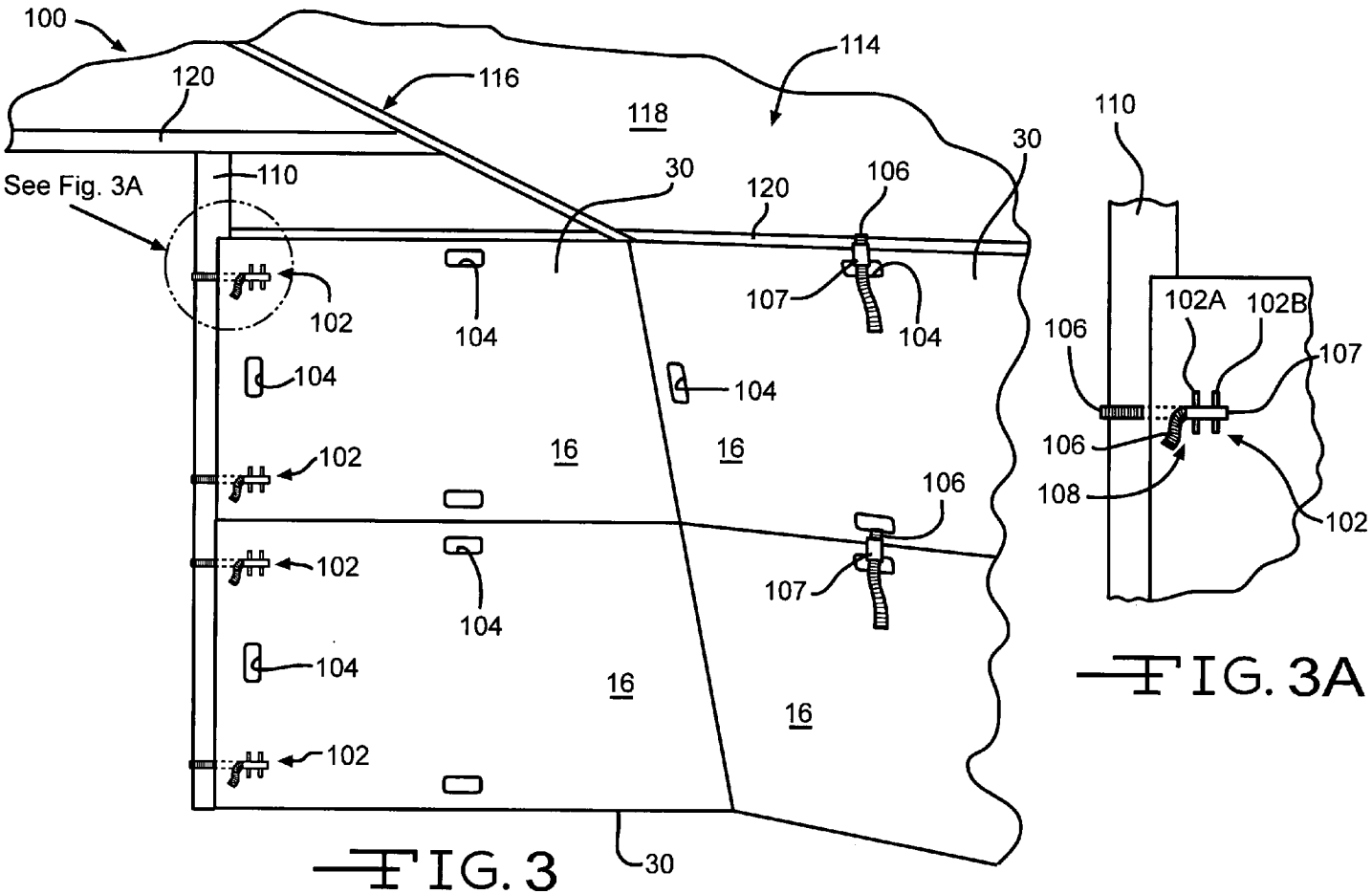
FIG. 3 is a schematic illustration of an interior of a tent having a plurality of a third embodiment of the protective composite panels illustrated in FIGS. 1 and 2.
Figure 4:
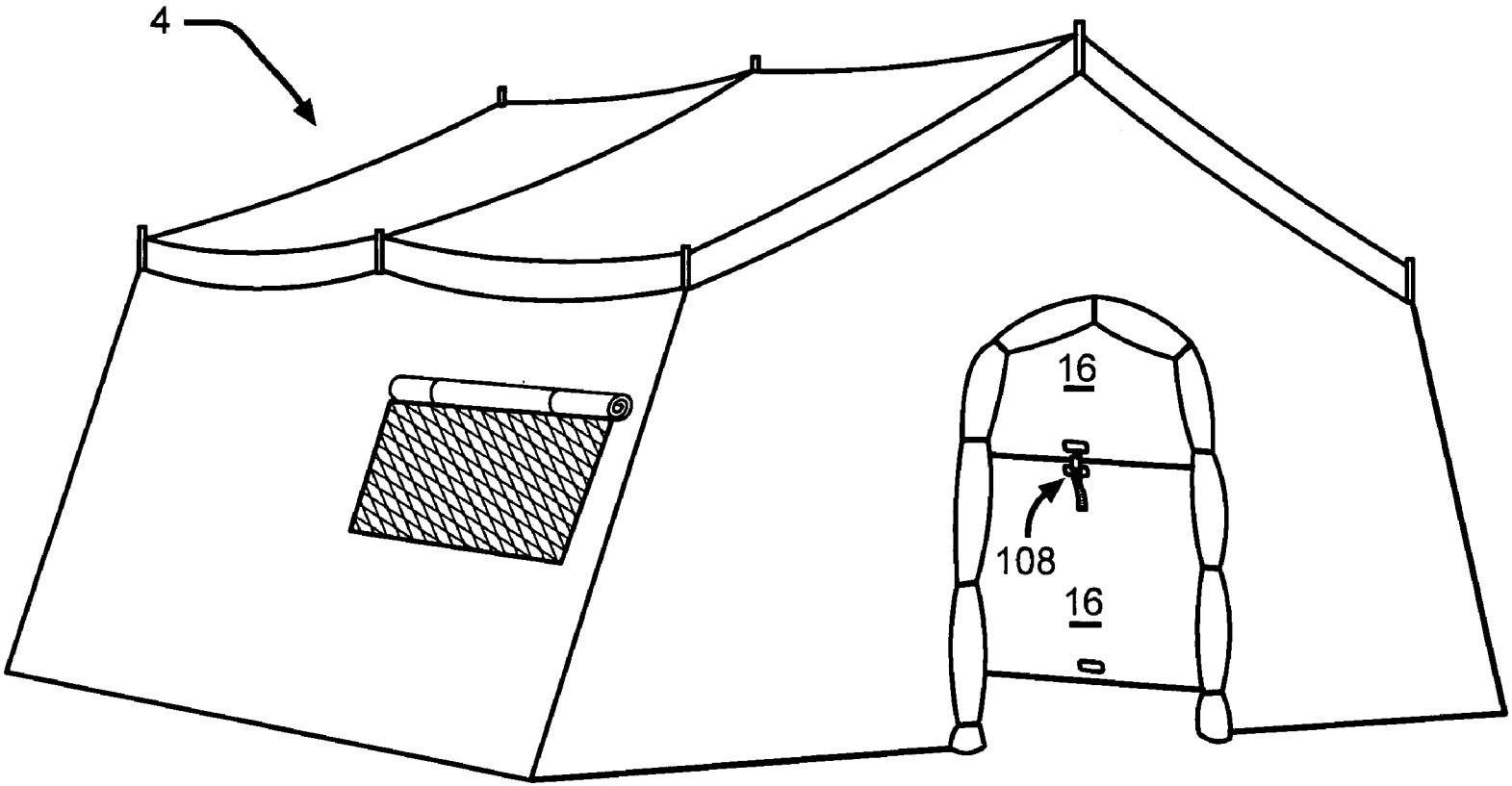
FIG. 4 a schematic illustration of the exterior of the tent illustrated in FIG. 3.
Figure 6:
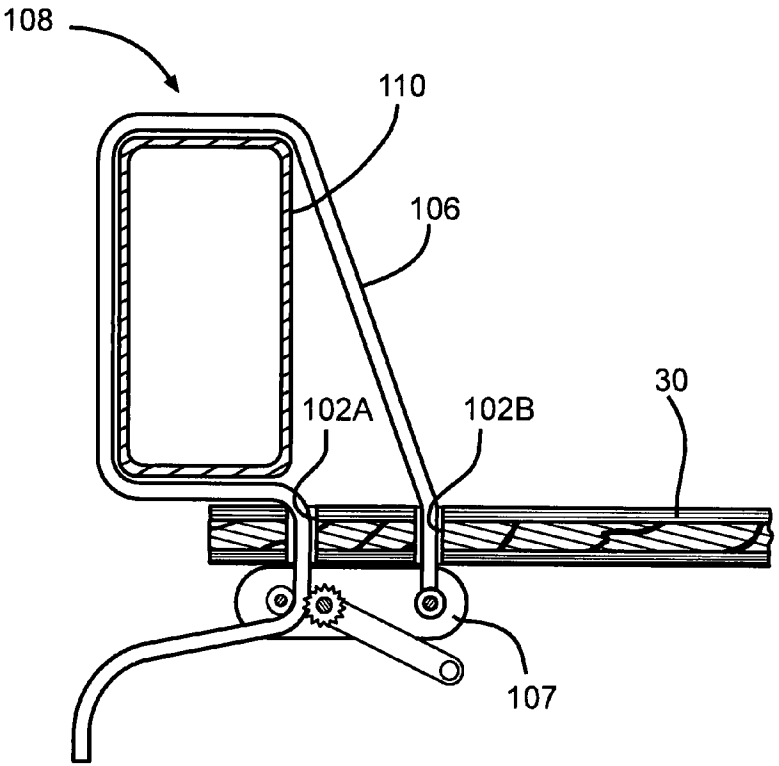
FIG. 6 is a schematic top view of a first embodiment of the connection system illustrated in FIGS. 3 and 3A.

Referring now to FIG. 3, there is illustrated generally at 100, a first embodiment of tent ballistic protection system. The illustrated system 100 includes a plurality of composite panels, such as the panels 30, described herein. The panels 30 may be provided in any size and shape, such as the size and shape of the vertical walls of a tent 114 having a frame 116, as best shown in FIG. 4.

The panels 30 may include a plurality of attachment slots 102. In the embodiment illustrated in FIGS. 3 and 5, the slots 102 are formed as pairs of slots 102A and 102B. The illustrated slots 102A and 102B are formed adjacent a peripheral edge of the panel 30. It will be understood that any desired number of slots 102 may be provided, such as for example one slot, three slots, or more than three slots. The slots 102A and 102B may be of any desired length and width. In the illustrated embodiment, the slots 102A and 102B have a length long enough to receive a plurality of strap 106 sizes, as will be described in detail herein. Likewise, the slots 102A and 102B have width wide enough to receive straps 106 having a plurality of thicknesses. Alternatively, the second and third embodiments of the attachment slot, 104 and 104', respectively, may also be provided in the panel 10, 10', 10", and 30 in any desired number and any desired location in the panel 10, 10', 10", and 30. In the illustrated embodiment, the slot 104 may also function as a carrying handle for the panel 30.

In the exemplary embodiment illustrated, a strap, such as a tie-down strap 106, is also provided. The illustrated strap 106 is a nylon web strap with cam-buckle 107. It will be understood however, that any other suitable strap or tie-down device may be used, such as for example, straps with hook and loop type fasteners, straps with couplings such as those commonly used by rock climbers, or plastic locking tie-straps.

Figure 5:
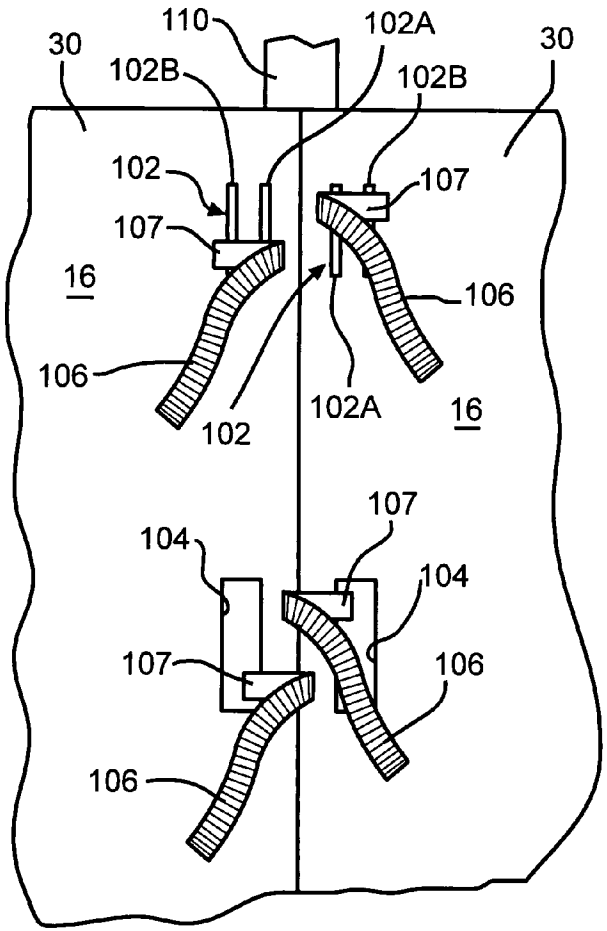
FIG. 5 is an enlarged schematic view of the interior of the tent illustrated in FIG. 3

As best shown in FIGS. 3 and 5, the slots 102A and 102B of the panel 30 and the strap 106 cooperate to define a connection system 108. In the exemplary embodiment illustrated, the system 108 further includes a supplementary vertical member 112, which will be described in detail below. In operation, and as best shown in FIGS. 3 and 5, the straps 106 may be inserted through the slot 102A, around any vertical frame member 110 of the tent 114, through the slot 102B and into a strap fastening mechanism, such as the buckle 107. The strap 106 may then be tightened, thereby causing the panel 30 to snugly engage the vertical frame member 110 of the tent frame 116. Adjacent panels 30 may be similarly attached to any desired vertical member 110, as best shown in FIG. 5. As used herein, vertical is defined as substantially perpendicular to the ground or other surface upon which the tent 114 is erected.

If desired, the panel 30 may be attached adjacent a roof panel 118 of the tent 114. For example, the strap 106 may be inserted through the slot 104 and around a horizontal frame member or cross-beam 120, as shown in FIG. 3.

By using the connection system 108, the panels 30 may be rapidly attached to an existing tent frame 116. The panels 30 may further be attached to the existing tent frame 116 without the need for additional tools. It will be understood however, that the straps 106 of the connection system 108 may also be rapidly decoupled or detached from the tent frame 116 without the need for additional tools.

Figure 8:
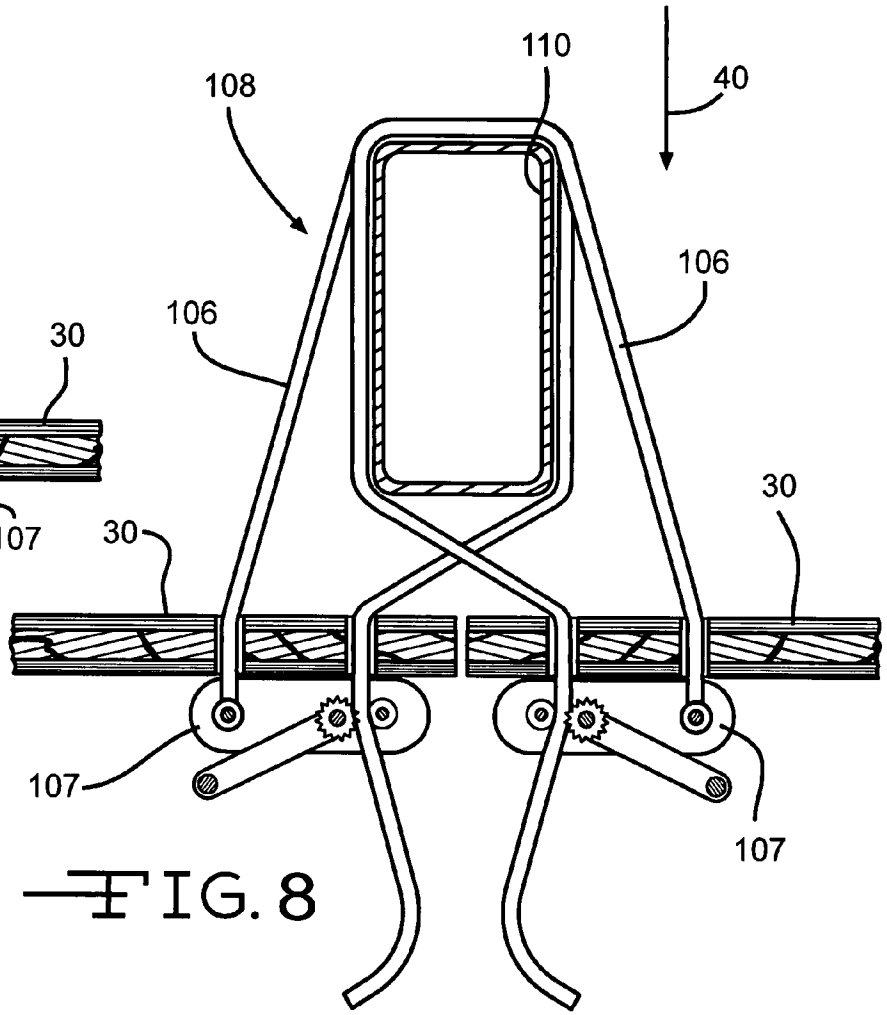
FIG. 8 is a schematic top view of the connection system illustrated in FIG. 7, shown during application of a blast force.
Figure 7:
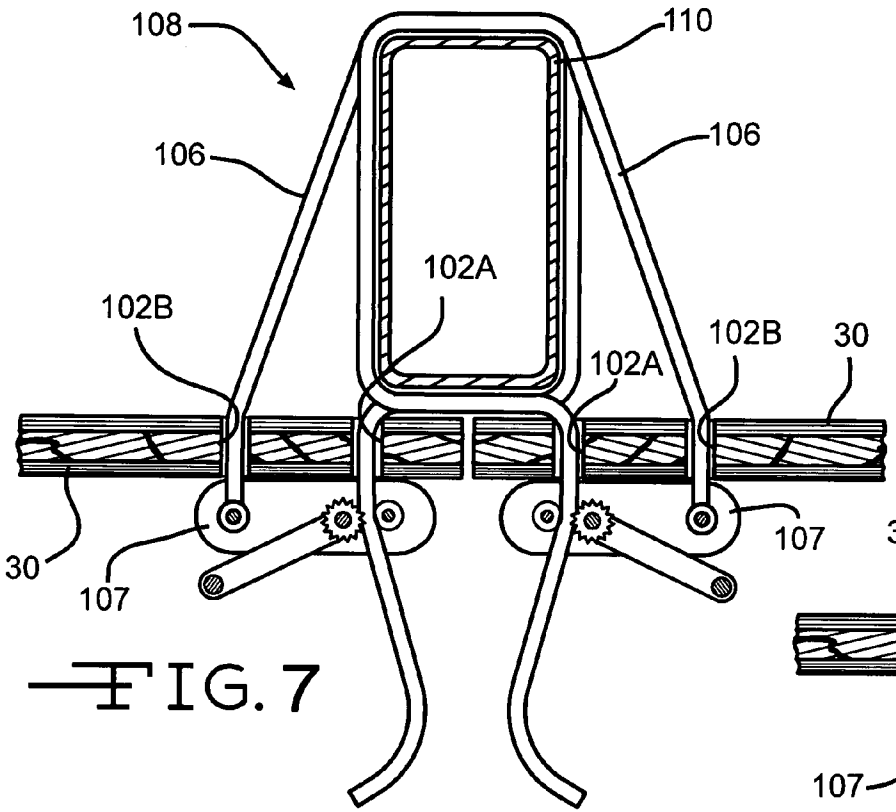
FIG. 7 is a schematic top view of a second embodiment of the connection system illustrated in FIG. 5.

Advantageously, the connection system 108, has been shown to reduce localized blast stresses on the panels 30. As best shown in FIGS. 3 and 5 through 7, the connection system 108 having two slots 102A and 102B, allows the panels 30 to be tightened to be snug to the tent frame 116. The system 108 further allows for movement during a dynamic blast loading event. For example, in the exemplary embodiment illustrated, the straps 106 are tightened to connect the panels 30 to the vertical members 110 of the tent frame 116, as shown in 3 and 5 through 7. Such a system 108, when assembled as described herein, allows adjacent panels 30 to pull away from the vertical member 110 to which the panels 30 are attached, as the straps 106 yield in response to a blast load, as indicated by the arrow 40. During and in response to such a blast load, the straps 106 of adjacent panels 30 extend inwardly and form a substantially 'X' shape when viewed from above, as shown in FIG. 8. By responding to a blast load as described herein, the system 108 increases the period, or vibration response, of the panels 30, and frame to which they are attached, and further reduces the blast pressure on the panels 30 and frame to which they are attached by within the range of from about 50 percent to about 20 percent of the blast pressure applied. The system 108 further reduces the membrane forces, or blast pressure, on the tent frame 116.

A tent or plurality of tents, such as the tent 114 illustrated in FIG. 4, may have an insufficient number of vertical members 110 from which to attach the panels 30, such as near a doorway of the tent 114. In such a situation, a supplementary vertical elongated member, such as illustrated at 110A in FIG. 8, may be provided as a component of the connection system 108. The vertical member 112 may include a base plate 113 at a lower end 112A thereof. The base plate 113 may include one or more holes 122 for receiving pins or stakes for securing the member 112 to the ground. An upper end 112B of the member 112 may include a hook, such as for example, a substantially 'U' shaped hook 124 for attaching the member 112 to a horizontal cross-beam, such as the cross-beam 120. One or more persons may simply lift the member 112 to engage the hook 124 with the horizontal cross-beam 120, thereby allowing attachment of the member 112 without tools, without a ladder, and without altering or modifying the tent frame 116.

The panels may be manufactured in any desired length and width, and may therefore be manufactured to accommodate any size tent and tent frame 116.

In the illustrated embodiment, the panels are installed inside the tent 114, i.e. under the tent fabric, so as not to be visible to the enemy in a combat environment. Placement within the tent further protects the panels 30 from potential environmental damage (i.e. from moisture, and UV radiation), thereby increasing durability.

One advantage of the composite panels 30 illustrated in FIGS. 2, 3, and 5, is that the combination of the attachment slots 102 and/or 104 formed near the peripheral edge of each composite panel 30, and the straps 106 allow for rapid attachment of the panels 30 to an existing tent frame 116, such as for example within about 30 minutes by four people. Additionally, the panels 30 are light enough to be carried by four persons, such as for example four women in the fifth percentile for human physical characteristics as discussed in MIL-STD-1472F, 1999.

Another advantage of the illustrated composite panels 30 is that the panels 30 can span a typical distance, such as 8 ft, between vertical tent frame members 110 without requiring intermediate or supplemental vertical support.

Another advantage is that in locations where multiple tents 114 are erected in close proximity to one another, the tents 114 can be arranged such that the composite panels 30 in one tent 114 provides additional ballistic and blast protection to occupants in adjacent tents 114.

It will be understood that the panels 10, 10', and 30 can be used in other types of temporary, semi-permanent, or permanent structures which may require protection from blast and/or from ballistic projectiles. Examples of such structures include containerized housing units, containerized medical units, containerized mechanical, sanitation, and electrical generation systems, air beam tents, trailer units such as construction trailers, mobile homes used for housing and/or work areas, modular buildings, conventional wood frame structures, and SEAHUTS.

The principle and mode of operation of the composite panel for blast and ballistic protection have been described in its various embodiments. However, it should be noted that the improved multifunctional composite panel for blast and ballistic protection described herein may be practiced otherwise than as specifically illustrated and described without departing from its scope.

What is claimed is:

1. A ballistic and blast protective composite panel having opposing major faces and a peripheral edge, the protective composite panel comprising:

a first composite layer;

a second composite layer;

a core disposed between said first and second composite layers, said core formed from one of wood and a wood product; and an encapsulation layer substantially covering all outer surfaces of said protective composite panel;

wherein said outer surfaces of said protective composite panel include said opposing major faces and said peripheral edge; and wherein said encapsulation layer defines an environmental protective layer that mitigates negative effects of the environment.

2. The protective composite panel according to claim 1, wherein said first and second composite layers comprise glass fiber.

3. The protective composite panel according to claim 2, wherein one of said first and second composite layers further includes thermoplastic resin.

4. The protective composite panel according to claim 1, further including a backing layer disposed on an outwardly facing surface of said second composite layer.

5. The protective composite panel according to claim 4, wherein said backing layer includes aramid material.

6. The protective composite panel according to claim 5, wherein said backing layer includes woven aramid fibers.

7. The protective composite panel according to claim 5, wherein said backing layer includes non-woven aramid fibers.

8. The protective composite panel according to claim 1, wherein said encapsulation layer includes polypropylene.

9. The protective composite panel according to claim 1, wherein said protective composite panel has an areal density substantially within the range of 2.0 pounds per square foot to 4.25 pounds per square foot.

10. The protective composite panel according to claim 1, wherein said protective composite panel includes an attachment aperture formed therethrough.

11. The protective composite panel according to claim 1, wherein said protective composite panel includes a fiber layer between said backing layer and said encapsulation layer.

12. The protective composite panel according to claim 11, wherein said fiber layer includes polyester fibers.

13. The protective composite panel according to claim 12, wherein said fiber layer is a layer of non-woven polyester fibers.

14. A ballistic and blast protection system comprising:

a plurality of protective composite panels, each said panel including:

a first composite layer;

a second composite layer;

a core disposed between said first and second composite layers;

a backing layer disposed on an outwardly facing surface of said second composite layer;

an encapsulation layer covering all exposed surfaces of said protective composite panel; and a fiber layer between said backing layer and said encapsulation layer;

wherein each composite panel includes a plurality of attachment apertures formed therethrough;

an elongated member; and a connection system comprising at least one strap, said strap extending through at least one of said apertures in adjacent ones of said composite panels, said connection system connecting each said composite panel to at least one of said elongated member and an adjacent composite panel.

15. A ballistic and blast protective composite panel comprising:

a first layer comprising glass fiber and thermoplastic resin;

a second layer comprising glass fiber and thermoplastic resin;

a core disposed between said first and second composite layers, said core being formed from one of wood and a wood product;

a backing layer disposed on an outwardly facing surface of said second composite layer, said backing layer including aramid material;

a polypropylene encapsulation layer covering all exposed surfaces of said protective composite panel; and a layer of polyester fiber between said backing layer and said encapsulation layer;

wherein said protective composite panel includes a plurality of attachment apertures formed therethrough.

16. The ballistic and blast protection system according to claim 14, wherein said elongated member extends between a portion of a structure to which said ballistic and blast protection system is connected and a composite panel.

17. The ballistic and blast protection system according to claim 14, wherein said ballistic and blast protection system is connected to frame members of a tent.

18. The ballistic and blast protection system according to claim 17, wherein said composite panels of said ballistic and blast protection system are connected to said frame members of said tent by said straps of said connection system.

19. The ballistic and blast protection system according to claim 18, wherein during a dynamic blast loading event, said panels and said straps of said connection system are movable from a first position wherein said panels are adjacent said frame members to a second position wherein a blast load occurring during said dynamic blast loading event urges said panels outwardly of said frame members, thereby extending said straps and increasing a vibration response of said panels.

20. A ballistic and blast protective composite panel having opposing major faces and a peripheral edge, the protective composite panel comprising:

a first layer comprising glass fiber and thermoplastic resin;

a second layer comprising glass fiber and thermoplastic resin;

a core disposed between said first and second composite layers, said core being formed from one of wood and a wood product;

a backing layer disposed on an outwardly facing surface of said second composite layer, said backing layer including aramid material;

a polypropylene encapsulation layer substantially covering all outer surfaces of said protective composite panel; and a layer of polyester fiber between said backing layer and said encapsulation layer;

wherein said outer surfaces of said protective composite panel include said opposing major faces and said peripheral edge; and wherein said encapsulation layer defines an environmental protective layer that mitigates negative effects of the environment.

* * * * *